US005522366A

United States Patent [19]

Konno et al.

[11] Patent Number: 5,522,366

[45] Date of Patent: Jun. 4, 1996

[54] FUEL INJECTION CONTROL APPARATUS FOR INTERNAL COMBUSTION ENGINE

[75] Inventors: Yoshihiro Konno, Kyoto; Shinji Mieda, Okazaki; Koji Nishimoto; Takanori, Fujimoto, both of Himeji, all of Japan

[73] Assignees: Mitsubishi Denki Kabushiki Kaisha; Mitsubishi Jidosha Kogyo Kabushiki Kaisha, both of Tokyo, Japan

[21] Appl. No.: 345,715

[22] Filed: Nov. 22, 1994

[30] Foreign Application Priority Data

Dec. 16, 1993 [JP] Japan ..... 5-316531

[51] Int. Cl.[6] ..... F02M 51/00

[52] U.S. Cl. ..... 123/492

[58] Field of Search ..... 123/339.1, 486, 123/492, 491, 493, 339; 364/431.06

[56] References Cited

U.S. PATENT DOCUMENTS

| | | | |
|---|---|---|---|
| 5,261,370 | 11/1993 | Ogawa et al. | 123/339 |
| 5,277,164 | 1/1994 | Takahashi et al. | 123/492 |
| 5,341,786 | 8/1994 | Abe et al. | 123/492 |
| 5,349,933 | 9/1994 | Hasegawa et al. | 123/486 |
| 5,353,768 | 10/1994 | Messih et al. | 123/491 |
| 5,383,126 | 1/1995 | Ogawa et al. | 364/431.06 |

FOREIGN PATENT DOCUMENTS

| | | | |
|---|---|---|---|
| 150043 | 9/1983 | Japan | 123/492 |

*Primary Examiner*—Raymond A. Nelli

*Attorney, Agent, or Firm*—Sughrue, Mion, Zinn, Macpeak & Seas

[57] ABSTRACT

A fuel injection control apparatus for an internal combustion engine capable of making correctly or properly decision as to acceleration and deceleration of engine without fail on the basis of magnitude of change in the intake air quantity while excluding erroneous deceleration or acceleration decision due to overshoot or undershoot in the intake air quantity to thereby allow the exhaust gas air-fuel ratio to be maintained at least close to a stoichiometric ratio. The apparatus includes an electronic control unit comprised of a throttle-acceleration decision module, a fuel injection decreasing module and a fuel injection increasing module. When acceleration is determined by the throttle-acceleration decision module, a deceleration decision reference value used by the fuel injection decreasing module is set to a value greater than a normal value for a predetermined period after the decision of acceleration, while when deceleration is determined, an acceleration decision reference value for the fuel injection increasing module is set to a value greater than a normal value for a predetermined period after the decision of deceleration. The acceleration decision reference value and the deceleration reference value are compared with magnitude of change in the amount of intake air by the fuel increasing module and the fuel decreasing means for deciding the acceleration and the deceleration, respectively.

12 Claims, 6 Drawing Sheets

FUEL INJECTION CONTROL APPARATUS FOR INTERNAL COMBUSTION ENGINE

BACKGROUND OF THE INVENTION

1. Field of the Invention

The present invention relates to a fuel injection control apparatus for controlling an amount of fuel supplied to an internal combustion engine for a motor vehicle or automobile or the like.

2. Description of the Related Art

In general, in the internal combustion engine (hereinafter also referred to simply as the engine) and in particular in the engine for a motor vehicle equipped with an exhaust gas purification system in which a tertiary catalytic converter (also known as the catalytic converter rhodium or CCRO in abbreviation) is employed, it is required to maintain the air-fuel ratio of an exhaust gas resulting from combustion of a fuel mixture within the engine cylinder (hereinafter this air-fuel ratio will be referred to as the exhaust gas air-fuel ratio for convenience of description) at a value very close to a stoichiometric air-fuel ratio. To this end, when the engine is in the acceleration state or mode, the amount of fuel injection determined on the basis of, for example, the rotation number (rpm) of the engine, a load imposed on the engine and other factors is increased by a proportion which corresponds to the acceleration, while when the engine is in the deceleration mode, the above-mentioned fuel amount is decreased by a proportion equivalent to the deceleration so that the optimal exhaust gas air-fuel ratio can be realized regardless of changes in the engine operation state.

In the fuel injection control apparatus for the engine system of the type mentioned above, it is necessary to detect the engine operation state, i.e., acceleration and deceleration states or modes of the engine. Under the circumstances, the acceleration and the deceleration of the engine are generally determined on the basis of the magnitude of change (or rate of change) in the outputs of an intake air flow sensor or a pressure sensor for detecting a pressure prevailing in an intake pipe, which outputs can typically represent the load of the engine, wherein the amount of fuel injection is increased or decreased in dependence on the change in the engine load. In that case, the output signals of the air flow sensor or the pressure sensor are inputted to the fuel injection control apparatus in the form of electric signals on the basis of which decision as to acceleration and deceleration is performed.

In the fuel injection control apparatus mentioned above, predetermined values defining a dead zone are previously set in consideration of influences of noise to the electric signals, wherein the decision concerning acceleration and deceleration is validated only when the magnitude of change in the electric signals made use of for determining the acceleration and deceleration deviates from the dead zone.

In conjunction with the fuel injection control apparatus for the engine which is implemented in such structure as described above, there naturally arises a demand for performing the decision as to acceleration and deceleration of the engine with a high accuracy because of necessity for holding the exhaust gas air-fuel ratio at a value at least approximating the stoichiometric air-fuel ratio in the acceleration and deceleration mode of the engine, which in turn requires that the width of the dead zone (or reference value range) be set as narrow as possible while taking into account a noise margin.

Further, the fuel injection control apparatus known heretofore suffers from a problem that when the engine operation is accelerated by depressing steeply the acceleration pedal to a depth corresponding to a predetermined opening degree of the throttle valve, there may take place overshoot in the output level of the air flow sensor and the pressure sensor, which will lead to an erroneous decision that the acceleration is erroneously taken as deceleration, making thus it impossible to maintain the exhaust gas air-fuel ratio close to the stoichiometric ratio, to a great disadvantage.

Besides, when the engine is decelerated, that is, when the acceleration pedal is released to such an extent that the throttle valve is fully closed, undershoot may take place in the output signal levels of both the intake air flow sensor and the pressure sensor, as a result of which a decision of engine acceleration is performed in spite of a deceleration state, so that the exhaust gas air-fuel ratio can not be maintained at a value close to the stoichiometric ratio, giving rise to another problem.

SUMMARY OF THE INVENTION

In the light of the state of the art described above, it is an object of the present invention to provide a fuel injection control apparatus for an internal combustion engine, which apparatus is capable of making correctly or properly the decision as to acceleration and deceleration of the engine without fail on the basis of magnitude (or rate) of change in the output signal level of an intake air flow sensor, a pressure sensor or the like while precluding the erroneous deceleration or acceleration decision due to overshoot or undershoot in the output signal levels of the intake air flow sensor, the pressure sensor and/or the like, to thereby allow the exhaust gas air-fuel ratio to be maintained as close as possible to the stoichiometric ratio.

In view of the above and other objects which will become apparent as description proceeds, there is provided according to a first aspect of the present invention a fuel injection control apparatus for an internal combustion engine, which apparatus includes a load detecting means for detecting a load of the engine, a fuel increasing means for increasing an amount of fuel injected into the engine by deciding acceleration of the engine when an increase in the engine load detected by the load detecting means during a predetermined period exceeds a first preset acceleration decision reference value, a fuel decreasing means for decreasing the amount of fuel injected into the engine by deciding deceleration of the engine when a decrease in the load detected by the load detecting means during a predetermined period exceeds a first preset deceleration decision reference value, a throttle position detecting means for detecting an opening degree of a throttle valve of the engine, a throttle acceleration decision means for deciding acceleration of the engine when magnitude of change of the throttle opening in a positive direction during a predetermined period as detected by the throttle position detecting means exceeds a preset decision reference value, and a change-over means for changing over the first deceleration decision reference value for the fuel decreasing means to a value greater than a normal value for a predetermined period from a time point when decision of acceleration is made by the throttle acceleration decision means.

By virtue of the structure of the fuel injection control apparatus described above, possibility of erroneous deceleration decision can positively be precluded even upon occurrence of overshoot in the output signal of the air flow sensor or the intake pipe pressure sensor at the end of the engine accelerating operation, whereby the exhaust gas air-fuel ratio can be maintained at a value at least closely approximating the stoichiometric air-fuel ratio. Further, because the first deceleration decision reference value is changed over to a greater value only during the predetermined period following the decision of acceleration, the first deceleration decision reference value can be set at a sufficiently small value while taking into account the noise margin in the normal deceleration of the engine as typified by the closing of the throttle valve, whereby correct deceleration decision can be performed in dependence on the change in the output signal of the air flow sensor and/or the intake pipe pressure sensor.

According to a second aspect of the invention, there is provided a fuel injection control apparatus for an internal combustion engine, which apparatus includes a load detecting means for detecting a load of the engine, a fuel increasing means for increasing an amount of fuel injected into the engine by deciding acceleration of the engine when an increase in the engine load detected by the load detecting means during a predetermined period exceeds a first preset acceleration decision reference value, a fuel decreasing means for decreasing the amount of fuel injected into the engine by deciding deceleration of the engine when a decrease in the load detected by the load detecting means during a predetermined period exceeds a first preset deceleration decision reference value, a throttle position detecting means for detecting an opening degree of a throttle valve of the engine, a throttle deceleration decision means for deciding deceleration of the engine when magnitude of change of the throttle opening in a negative direction during a predetermined period as detected by the throttle position detecting means exceeds a preset decision reference value, and a change-over means for changing over the first acceleration decision reference value for the fuel increasing means to a value greater than a normal value for a predetermined period from a time point when decision of deceleration is made by the throttle deceleration decision means.

Owing to the structure of the fuel injection control apparatus described above, possibility of erroneous acceleration decision can positively be precluded even upon occurrence of overshoot in the output signal of the air flow sensor or the intake pipe pressure sensor at the end of the engine decelerating operation, whereby the exhaust gas air-fuel ratio can be maintained at a value at least closely approximating the stoichiometric air-fuel ratio. Further, because the first acceleration decision reference value is changed over to a greater value only during the predetermined period following the decision of deceleration, the first acceleration decision reference value can be set at a sufficiently small value while taking into account the noise margin in the normal acceleration of the engine as typified by the opening of the throttle valve, whereby correct acceleration decision can be performed in dependence on the change in the output signal of the air flow sensor or the intake pipe pressure sensor.

According to a third aspect of the invention, there is provided a fuel injection control apparatus for an internal combustion engine, which apparatus includes a load detecting means for detecting a load of the engine, a fuel increasing means for increasing an amount of fuel injected into the engine by deciding acceleration of the engine when an increase in the engine load detected by the load detecting means during a predetermined period exceeds a first preset acceleration decision reference value, a fuel decreasing means for decreasing the amount of fuel injected into the engine by deciding deceleration of the engine when a decrease in the load detected by the load detecting means during a predetermined period exceeds a first preset deceleration decision reference value, and a change-over means for changing over the first deceleration decision reference value for the fuel decreasing means to a value greater than a normal value for a predetermined period from a time point when the increase of the engine load detected by the load detecting means for the predetermined period exceeds the first acceleration decision reference value or alternatively a second acceleration decision reference value which is greater than the first acceleration decision reference value.

By virtue of the structure of the fuel injection control apparatus described above, possibility of erroneous deceleration decision can positively be precluded even upon occurrence of overshoot in the output signal of the air flow sensor or the intake pipe pressure sensor at the end of the engine accelerating operation, whereby the exhaust gas air-fuel ratio can be maintained at a value at least closely approximating the stoichiometric air-fuel ratio. Further, because the first deceleration decision reference value is changed over to a greater value only during the predetermined period following the decision of acceleration, the first deceleration decision reference value can be set at a sufficiently small value while taking into account the noise margin in the normal deceleration of the engine as typified by the closing of the throttle valve, whereby correct deceleration decision can be performed in dependence on the change in the output signal of the air flow sensor or the intake pipe pressure sensor.

According to a fourth aspect of the invention, there is provided a fuel injection control apparatus for an internal combustion engine, which apparatus includes a load detecting means for detecting a load of the engine, a fuel increasing means for increasing an amount of fuel injected into the engine by deciding acceleration of the engine when an increase in the engine load detected by the load detecting means during a predetermined period exceeds a first preset acceleration decision reference value, a fuel decreasing means for decreasing the amount of fuel injected into the engine by deciding deceleration of the engine when a decrease in the load detected by the load detecting means during a predetermined period exceeds a first preset deceleration decision reference value, and a change-over means for changing over the first acceleration decision reference value for the fuel increasing means to a value greater than a normal value for a predetermined period from a time point when the decrease of the engine load detected by the load detecting means for the predetermined period exceeds the first deceleration decision reference value or alternatively a second deceleration decision reference value which is greater than the first deceleration decision reference value.

Owing to the structure of the fuel injection control apparatus described above, possibility of erroneous acceleration decision can positively be precluded even upon occurrence of overshoot in the output signal of the air flow sensor or the intake pipe pressure sensor at the end of the engine decelerating operation, whereby the exhaust gas air-fuel ratio can be maintained at a value at least closely approximating the stoichiometric air-fuel ratio. Further, because the first acceleration decision reference value is changed over to a greater value only during the predetermined period following the decision of deceleration, the first acceleration decision reference value can be set at a sufficiently small value while tatting into account the noise margin in the normal acceleration of the engine as typified by the opening of the throttle valve, whereby correct acceleration decision can be performed in dependence on the change in the output signal of the air flow sensor or the intake pipe pressure sensor.

The above and other objects, features and attendant advantages of the present invention will more easily be understood by reading the following description of the preferred embodiments thereof taken, only by way of example, in conjunction with the drawings.

DESCRIPTION OF THE PREFERRED EMBODIMENTS

Now, the present invention will be described in detail in conjunction with preferred or exemplary embodiments thereof by reference to the drawings.

Embodiment 1

Figure 1:
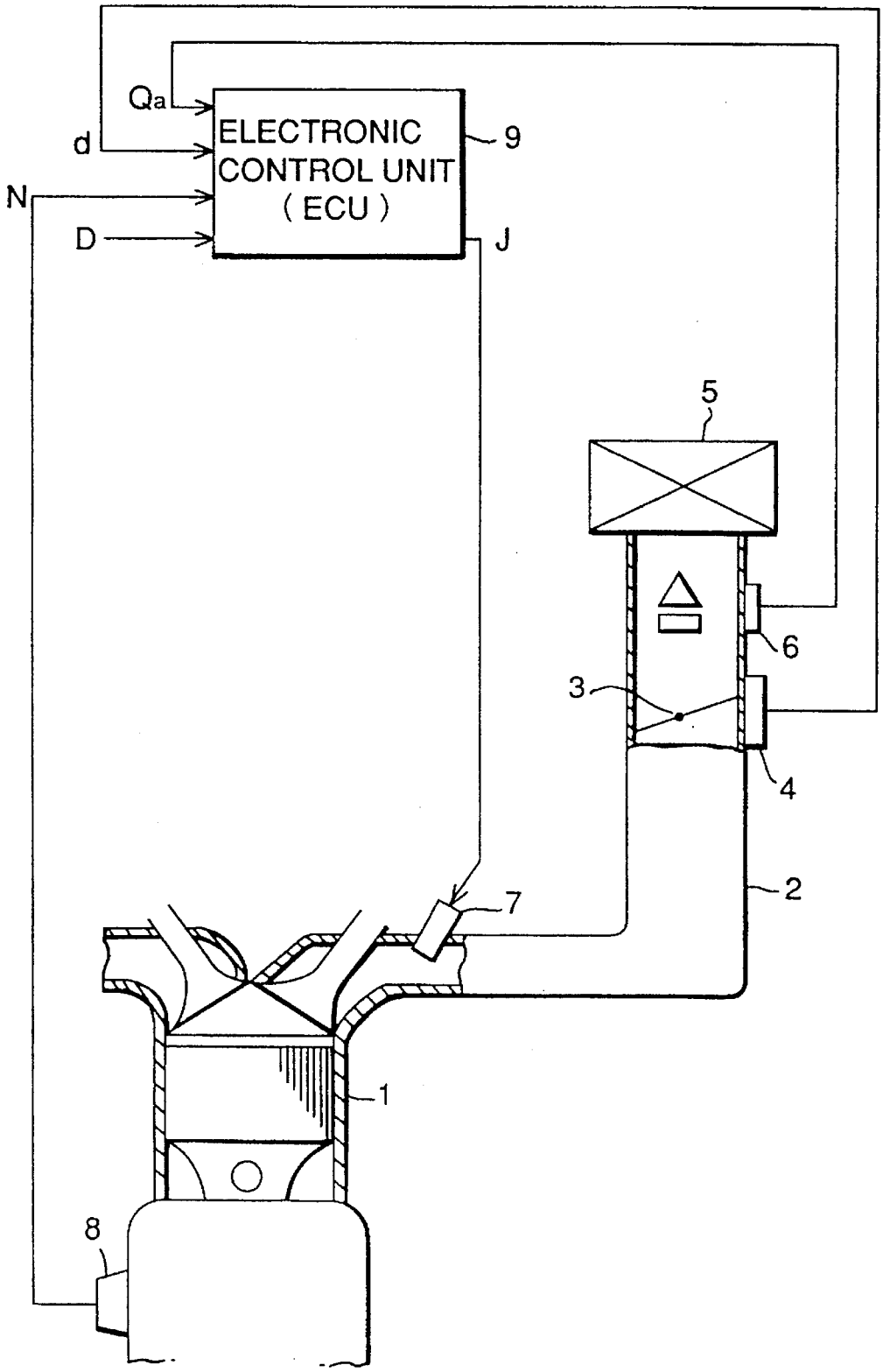
FIG. 1 is a block diagram showing schematically a structure of a fuel injection control apparatus for an internal combustion engine according to a first embodiment of the invention.

FIG. 1 is a block diagram showing schematically a structure of a fuel injection control apparatus for an internal combustion engine (hereinafter simply referred to as the engine) according to an embodiment of the invention.

As can be seen in the figure, the engine shown, as a four-cycle engine, by way of example, only includes a plurality of cylinders 1, an intake pipe 2 for introducing air into the engine cylinders 1, a throttle valve (also simply referred to as throttle) 3 which is so interlocked with an acceleration pedal (not shown) as to be opened and closed in dependence on actuation (depression and release) of the acceleration pedal to thereby control correspondingly the amount of intake air to be supplied to the engine, a throttle position sensor 4 constituting a throttle opening degree detecting means for detecting an opening degree $\alpha$ of the throttle valve 3 which indicates the amount of intake air flow fed actually to the engine, an air cleaner 5 disposed at an inlet portion of the intake pipe 2 for purifying the intake air, an air flow sensor 6 disposed at a position downstream of the air cleaner 5 for detecting the intake air flow (amount of the intake air) $Q_a$ and serving as an engine load detecting means, a fuel injector 7 disposed in the intake pipe 2 downstream of the throttle valve 3 for injecting a fuel into the engine cylinders, and an engine speed sensor 8 for detecting the engine speed or the rotation number Ne (rpm) of the engine 1.

An electronic control unit (hereinafter referred to as the ECU in abbreviation) 9 fetches signals representing the throttle valve opening degree $\alpha$, intake air amount $Q_a$ and the engine rotation number (rpm) Ne from the associated sensors 4, 6 and 8, respectively, as well as engine operation state signals D available from other various sensors such as a signal derived from the output of a water temperature sensor and indicating the warmed-up state of the engine, a signal indicative of the air-fuel ratio of an exhaust gas generated by an $O_2$-sensor and others, to thereby generate a driving signal J for driving the fuel injector 7 as well as other signals required for controlling the engine operation.

Figure 2:
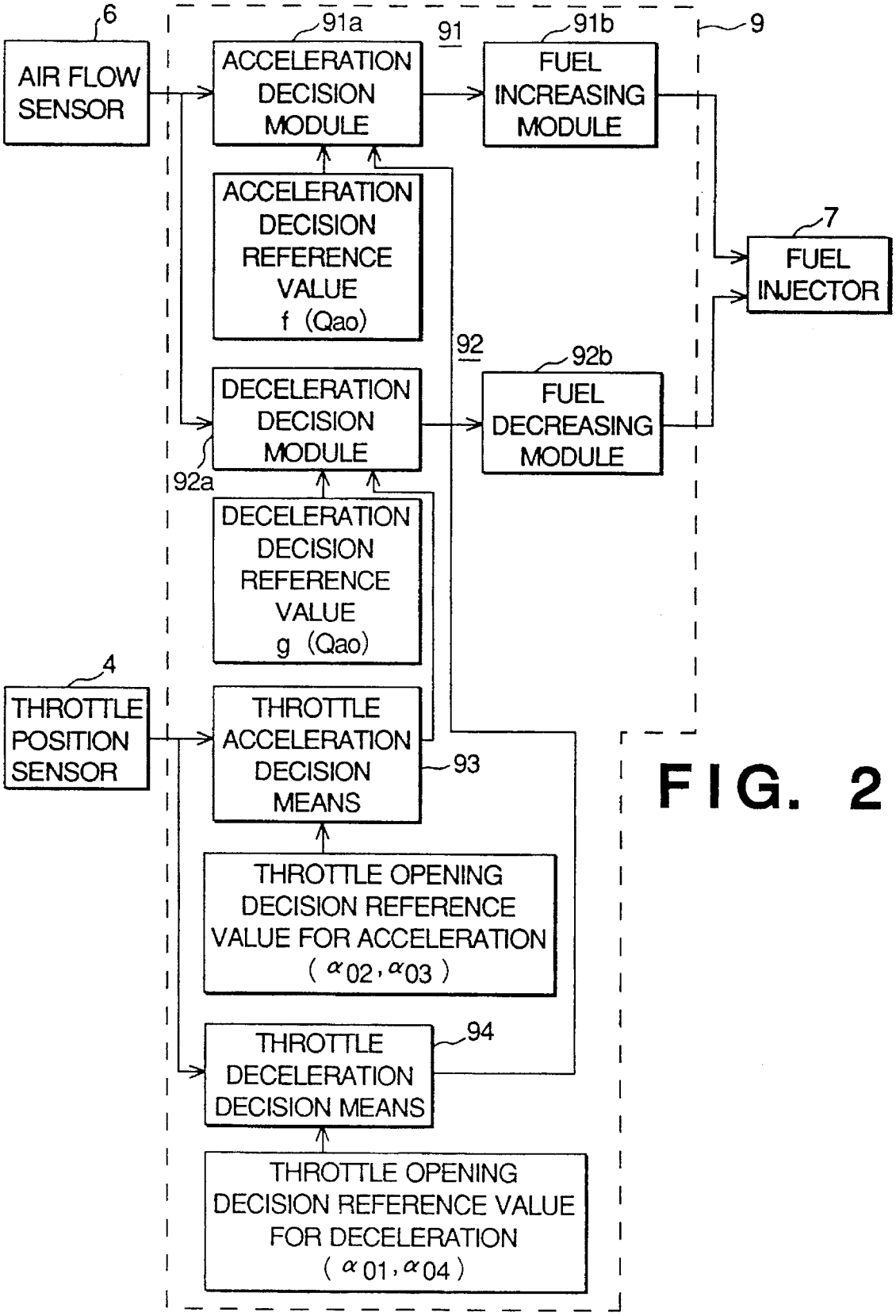
FIG. 2 is a functional block diagram showing an architecture of an electronic control unit (ECU) employed in the fuel injection control apparatus shown in FIG. 1.

As is shown in FIG. 2, the ECU 9 is comprised of an acceleration decision module 91*a* for deciding that the engine is in an acceleration mode when the magnitude of change in the intake air flow detected by the air flow sensor 6 is positive (i.e., of plus sign, indicating increase of the intake air flow) and when the value thereof is greater than a first acceleration decision reference value (elucidated later on), a fuel increasing module 91*b* for increasing the amount of fuel to be injected in the engine acceleration mode, a deceleration decision module 92*a* for deciding that the engine is in the deceleration mode when the magnitude of change of the intake air flow is negative (i.e., of minus sign, indicating decrease of the intake air flow) and when the absolute value thereof is greater than a first deceleration decision reference value (elucidated later on), and a fuel decreasing module 92*b* for decreasing the amount of fuel supplied to the engine in the engine deceleration mode. Parenthetically, the acceleration decision module 91 a and the fuel increasing module 91*b* cooperate to constitute a fuel increasing means 91 of the invention, while the deceleration decision module 92*a* and the fuel decreasing module 92*b* cooperate to constitute a fuel decreasing means 92 of the invention. Further, the ECU 9 includes a throttle acceleration means 93 which is so designed as to decide that the engine is in acceleration mode when the magnitude of change in the throttle opening degree of the throttle valve 3 as detected by the throttle position sensor 4 is plus sign (i.e., positive) and when the magnitude thereof remains greater than a preset decision reference value over a predetermined time span, and a throttle deceleration decision means which is so designed as to decide that the engine is in the deceleration mode when the magnitude of change in the throttle opening degree of the throttle valve 3 as detected by the throttle position sensor 4 is negative (i.e., of minus sign) and when the magnitude thereof remains greater than a preset decision reference value over a predetermined time span.

Operation of the electronic control unit or ECU 9 will now be described by reference to the flow charts shown in FIGS. 3 and 4. At first, description will be made by referring to the flow chart of FIG. 3.

The ECU 9 incorporates a ROM (Read-Only Memory) in which there is stored a program for a processing routine S1 to be executed at every predetermined crank angle by a microprocessor constituting a major part of the ECU although not shown in the course of a main routine processing. The routine S1 will hereinafter referred to as the crank angle interruption routine.

In a step S2, the output signal of the air flow sensor 6 provided for detecting the intake air amount $Q_a$ supplied to the engine is fetched.

In a step S3, an output value $Q_a'$ of the air flow sensor 6 which has been fetched in the preceding crank angle interruption routine S1 and stored in a random access memory or RAM (not shown)is read out.

In a step S4, the intake air amount $Q_a$ newly or currently fetched in the step S2 is stored as an updated air flow sensor output value $Q_a'$, which is then followed by a step S5 where an arithmetic operation given by $\Delta Q_a = Q_a - Q_a'$ is performed, where $Q_a$ represents the currently fetched air flow sensor output value, $Q_a'$ represents the air flow sensor output value read out from the RAM, and $\Delta Q_a$ represents a magnitude of change in the intake air amount during an interval or period corresponding to a predetermined crank angle intervening between the preceding crank angle interruption routine and the current one.

In a step S6, it is decided whether the magnitude of change $\Delta Q_a$ is of plus sign or minus sign, indicating whether the intake air amount is increased or decreased when compared with the one detected in the preceding crank angle interruption routine S1. When the magnitude of change $\Delta Q_a$ is of plus sign, the processing proceeds to a step for deciding whether or not the engine is in the acceleration state, while when decision is made that the $\Delta Q_a''$ is of minus sign, the processing proceeds to a step for deciding whether the engine is in the deceleration state.

More specifically, when it is decided that the change $\Delta Q_a$ of the intake air amount is of minus sign in the step S6, then the processing proceeds to a step S7 for determining the magnitude of the change $\Delta Q_a$ in accordance with the expression given by $\Delta Q_a=Q_a'-Q_a$. On the other hand, when the intake air amount $Q_a$ is decided as having the plus sign, indicating an increase of the intake air amount, the processing proceeds to a step S7 where the change $\Delta Q_a$ of the intake air amount is compared with a first acceleration decision reference value $f(Q_{a0})$ which is used for deciding whether or not the engine is in the acceleration mode and which can be set in a manner elucidated latter on.

When it is decided in the step S7 that the magnitude of change $\Delta Q_a$ of the intake air amount is greater than the first acceleration decision reference value $f(Q_{a0})$, the processing proceeds to a step S11 where a flag A is set to logic "1", which is then followed by a step S14 where the crank angle interruption routine is terminated. On the other hand, unless the magnitude of change $\Delta Q_a$ of the intake air amount is greater than the first acceleration decision reference value $f(Q_{a0})$, the processing proceeds to a step S10 where the flag A is set to "0", whereupon the instant interruption routine comes to an end in the step S14.

At this juncture, it should be mentioned that the flag A of "1" indicates that the engine is decided to be in the acceleration mode, while the flag A of "0" indicates that the engine is not accelerated.

Now turning back to the step S6, when it is decided that the magnitude of change $\Delta Q_a$ of the intake air amount is of minus sign, the processing proceeds to a step S8 where the magnitude of change $\Delta Q_a$ of the intake air amount is determined in accordance with the expression given by $\Delta Q_a=Q_a'-Q_a$, to store the magnitude of change $\Delta Q_a$ of minus sign, whereon the processing proceeds to a step S9.

In the step S9, the magnitude of change $\Delta Q_a$ of the intake air amount is compared with a first deceleration decision reference value $g(Q_{a0})$ which is used for making decision as to whether or not the engine is in the deceleration state and which can be determined in a manner elucidated later on.

When the decision in the step S9 results in that the magnitude of change $\Delta Q_a$ of the intake air amount is greater that the first deceleration decision reference value $g(Q_{a0})$, the processing proceeds to a step S12 where a flag B is set to logic "1", whereupon the processing is terminated in the step S14. On the other hand, when it is decided in the step S9 that the magnitude of change $\Delta Q_a$ is not greater than the first deceleration decision reference value $g(Q_{a0})$, the processing proceeds to a step S13 where the flag B is set to "0", whereupon the processing comes to an end in the step S14.

At this juncture, the flag B of "1" indicates that the engine is decided as being in the deceleration state while the flag B of "0" indicates that the engine is not in the deceleration state.

Figure 3:
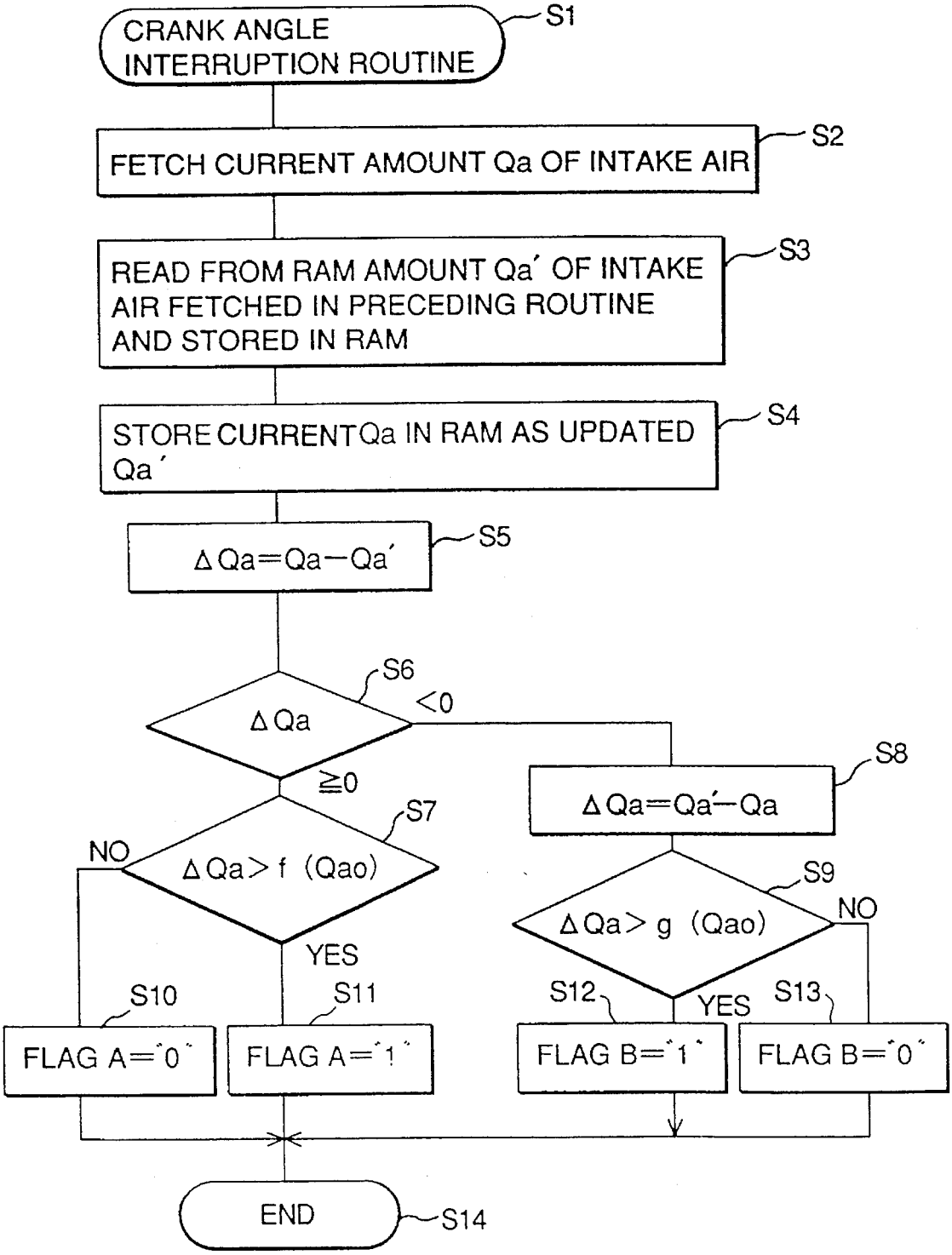
FIG. 3 is a flow chart for illustrating a method of deciding acceleration state and deceleration state as adopted in the fuel injection control according to the invention.

Although not shown in the flow chart of FIG. 3, when the flag A is set to "1", indicating the acceleration state of the engine, the amount of fuel supplied to the engine is increased by the fuel increasing module **91*b* (FIG. 2), while when the flag B is set to "1", indicating the deceleration state of the engine, the amount of fuel injected into the engine is decreased by the fuel decreasing module 92*b* (FIG. 2** ).

Figure 6:
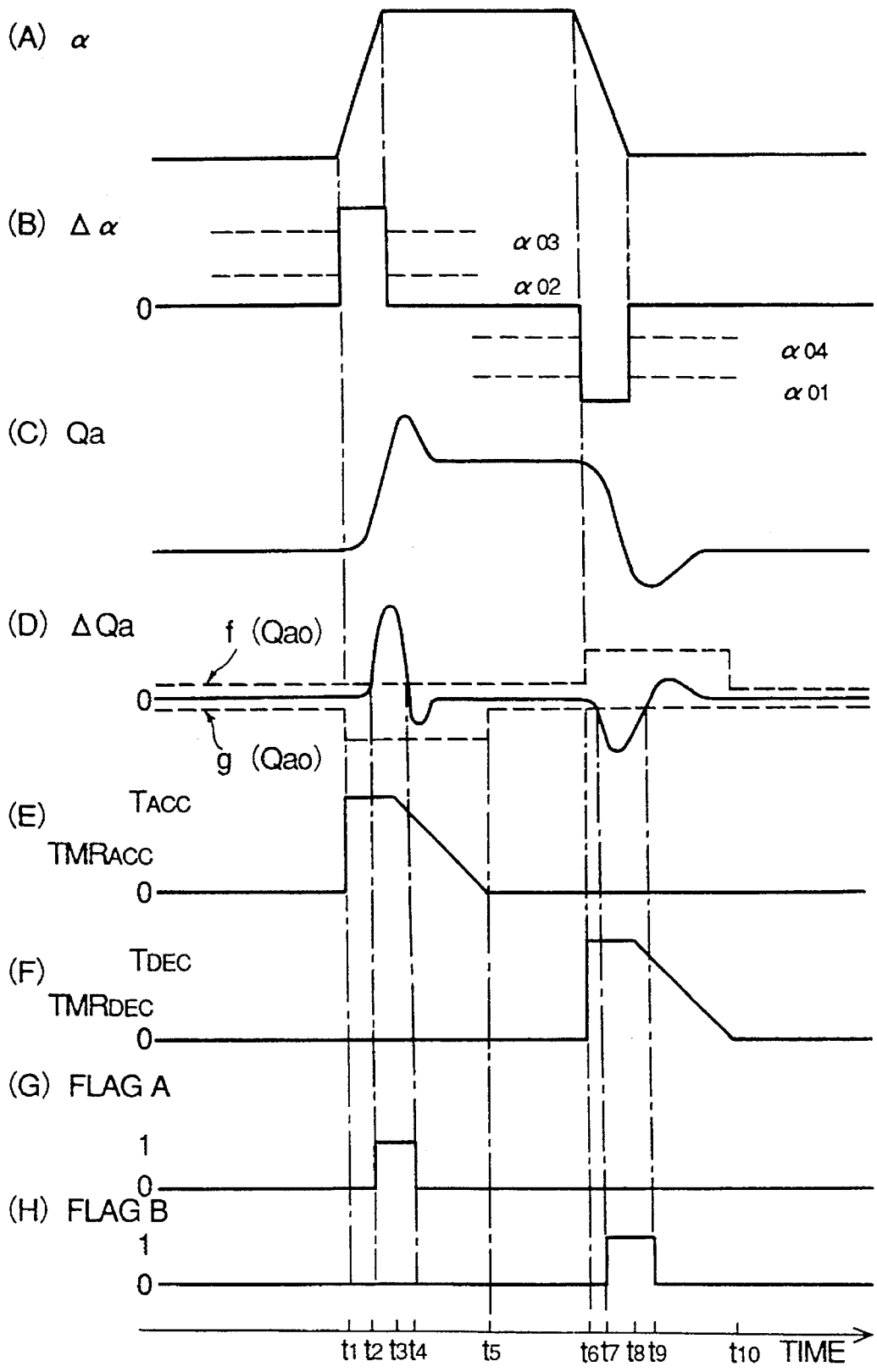
FIG. 6 is a view for graphically illustrating operations of the fuel injection control apparatus in the acceleration and deceleration states, respectively, of the engine.

Now, description will be made of the general concept underlying the fuel injection control apparatus according to the invention by reference to FIG. 6. As is apparent from the foregoing, decision as to whether the engine is in the acceleration state or in the deceleration state can be made by deciding whether the magnitude of change $\Delta Q_a$ of the intake air amount exceeds the first acceleration decision reference value $f(Q_{a0})$ or the first deceleration decision reference value $g(Q_{a0})$. Refer to FIG. 6 at (D).

As can be seen in FIG. 6 at (D), during a period from a time point $t_1$ to $t_5$, the first deceleration decision reference value $g(Q_{a0})$ is changed, while during a period from a time point $t_6$ to $t_{10}$, the first acceleration decision reference value $f(Q_{a0})$ is changed. Such changes of the first deceleration decision reference value $g(Q_{a0})$ and the first acceleration decision reference value $f(Q_{a0})$ are performed in dependence on a magnitude of change $\Delta\alpha$ of the throttle opening degree $\alpha$ which is periodically detected at every predetermined time interval, as illustrated in FIG. 6 at (B).

More specifically, when the magnitude of change $\Delta\alpha$ of the throttle opening degree $\alpha$ given by $\Delta\alpha=\alpha-\alpha'$ (where $\alpha$ represents the throttle opening degree detected in the preceding cycle and $\alpha'$ represents the throttle opening degree detected currently) satisfies the condition that $\Delta\alpha\geqq\alpha_{03}$ (where $\alpha_{03}$ represents a first preset throttle opening decision reference value), as shown in FIG. 6 at (B), decision is made that the engine is accelerated by depressing the acceleration pedal (i.e., by opening the throttle valve), whereupon a predetermined value $T_{ACC}$ is set in a timer $TMR_{ACC}$, as shown in FIG. 6 at (E). The content of this timer $TMR_{ACC}$ is decremented at every predetermined time interval and thus indicates a finite value not equal to zero during the acceleration brought about by the depression of the acceleration pedal (i.e., during a period where the condition that $\Delta\alpha\geqq\alpha_{03}$ is satisfied) and for a predetermined period starting from the detection of acceleration due to the depression of the acceleration pedal (i.e., opening of the throttle valve).

So long as the acceleration end decision timer $TMR_{ACC}$ contains a finite value not equal to zero, it is decided that the engine is not in the deceleration state due to the change in the throttle opening (e.g. the acceleration pedal is not released by the driver), and the first deceleration decision reference value $g(Q_{a0})$ is thus set at a greater value $XD_{HI}$ for invalidating the deceleration decision to thereby inhibit the fuel injection amount from being decreased against driver's will.

However, when the driver releases the acceleration pedal during the period in which the acceleration end decision timer $TMR_{ACC}$ contains a finite value (i.e., when the deceleration state of the engine due to decrease of the throttle opening degree $\alpha$ is detected, to say in another way), it is required to immediately set the first deceleration decision reference value $g(Q_{a0})$ back to a smaller value $XD_{LOW}$ to thereby allow the fuel injection to be decreased without difficulty.

In this case, when the throttle opining magnitude of change $\Delta\alpha$ ($=\alpha'-\alpha$) of minus sign (indicating the deceleration state of the engine) satisfies the condition that $\Delta\alpha\geqq\alpha_{04}$ (where $\alpha_{04}$ represents a first throttle-deceleration decision reference value), the value of the acceleration end decision timer $TMR_{ACC}$ is reset to zero.

Similarly, when the magnitude of change $\Delta\alpha$ (=$\alpha'-\alpha$) of minus sign satisfies the condition that $\Delta\alpha \geqq \alpha_{01}$ (where $\alpha_{01}$ represents a second throttle-deceleration decision reference value), it is decided that the engine is in the deceleration state, whereby a predetermined value $T_{DEC}$ is set in a deceleration end decision timer $TMR_{DEC}$, as illustrated in FIG. 6 at (F). So long as the timer $TMR_{DEC}$ contains a finite value, it is decided that the engine is not in the acceleration state due to the throttle opening (i.e., brought about by the actuation or depression of the acceleration pedal by a driver), and the first acceleration decision reference value $f(Q_{a0})$ is set at a large value $XA_{HI}$ to make it difficult or impossible to make the decision of the acceleration state, to thereby inhibit the increase of the fuel injection against driver's will. On the other hand, when the driver depresses the acceleration pedal during the period in which the deceleration end decision timer $TMR_{DEC}$ holds a finite value (i.e., when the magnitude of change $\Delta\alpha$ (=$\alpha-\alpha'$) of plus sign satisfies the condition that $\Delta\alpha \geqq \alpha_{02}$), the value $T_{DEC}$ of the deceleration end decision timer $TMR_{DEC}$ is reset to "0" to thereby allow the first acceleration decision reference value $f(Q_{a0})$ to be set to a smaller value $XA_{LOW}$ at which the fuel injection can be increased without difficulty.

Description will now be made of the reference values $\alpha_{03}$ and $\alpha_{02}$ employed in the decision concerning the acceleration brought about by opening the throttle valve.

It is only when the acceleration pedal is depressed steeply or speedily that undershoot can take place in the intake air amount $Q_a$ at the end of the acceleration phase. In order to cope with this phenomenon, it is necessary to set the first throttle-acceleration decision reference value $\alpha_{03}$ at a large value. To say in another way, the first throttle-acceleration decision reference value $\alpha_{03}$ is not used for increasing the fuel injection for the acceleration but employed only for inhibiting the fuel injection from being decreased due to the undershoot of the intake air amount $Q_a$.

On the other hand, it is necessary to set the second throttle-acceleration decision reference value $\alpha_{02}$ at as small a value as possible from the stand point of noise margin, because the second throttle-acceleration decision reference value $\alpha_{02}$ is used for immediately setting back the first acceleration decision reference value $f(Q_{a0})$ to the original small value when the deceleration end decision timer $TMR_{DEC}$ contains a finite value, i.e., when the first acceleration decision reference value $f(Q_{a0})$ is large.

For the reasons mentioned above, the second throttle-acceleration decision reference value $\alpha_{02}$ can be determined as small as possible while ensuring the noise margin. By contrast, the first throttle-acceleration decision reference value $\alpha_{03}$ is set at a value greater than the second throttle-acceleration decision reference value $\alpha_{02}$ and used only upon steep or rapid acceleration at which undershoot may occur in the intake air amount $Q_a$ immediately after the accelerating operation. It should however be mentioned that the performance of the fuel injection control apparatus according to the invention is essentially insusceptible subjected to any appreciable influence even when the first throttle-acceleration decision reference value $\alpha_{03}$ is set equal to the second throttle-acceleration decision reference value $\alpha_{02}$, which in turn means that the fuel injection control contemplated by the invention can be realized satisfactorily by using only the second throttle-acceleration decision reference value $\alpha_{02}$.

Same applies true for the second throttle-deceleration decision reference value $\alpha_{01}$ and the first throttle-deceleration decision reference value $\alpha_{04}$. Namely, the first throttle-deceleration decision reference value $\alpha_{04}$ is determined as small as possible while ensuring the noise margin as required. On the other hand, the second throttle-deceleration decision reference value $\alpha_{01}$ is set at a value greater than the first throttle-deceleration decision reference value $\alpha_{04}$ only upon steep deceleration at which overshoot may occur in the intake air amount $Q_a$ immediately in succession to the decelerating operation. Of course, the second throttle-deceleration decision reference value $\alpha_{01}$ can be set equal to the first throttle-deceleration decision reference value $\alpha_{04}$ or only the latter can be employed without sacrificing the performance of the fuel injection control apparatus according to the invention.

Figure 4:
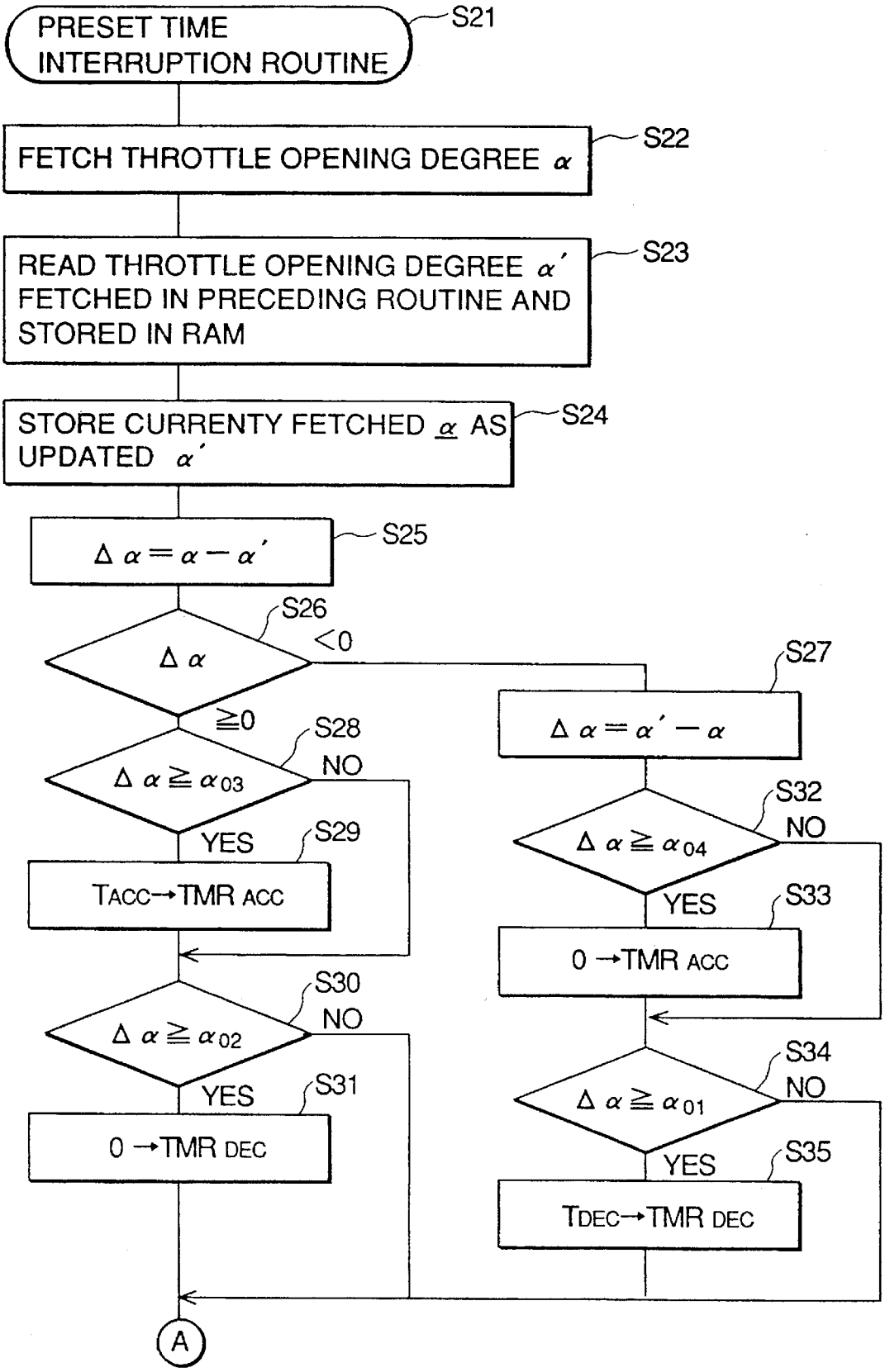
FIG. 4 is a flow chart for illustrating a method of setting an acceleration decision reference value and a deceleration decision reference value according to an embodiment of the present invention.
Figure 5:
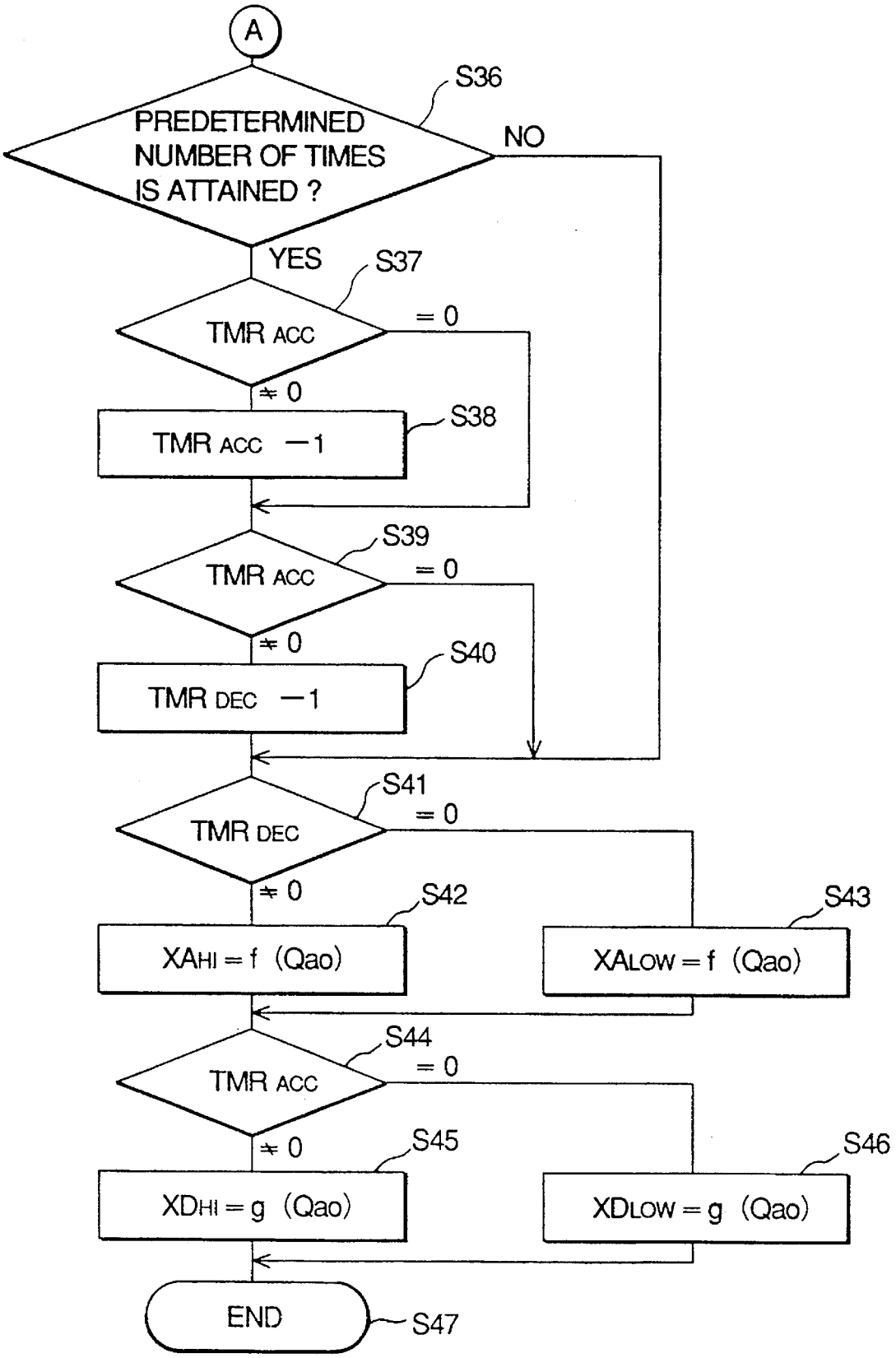
FIG. 5 is a flow chart for illustrating a method of setting an acceleration decision reference value and a deceleration decision reference value according to the embodiment of the present invention.

Next, referring to the flow charts shown in FIGS. 4 and 5, description will turn to the setting of the first acceleration decision reference value $f(Q_{a0})$ and the first deceleration decision reference value $g(Q_{a0})$.

The read-only memory or ROM (not shown)incorporated in the ECU 9 stores therein a program for an interruption routine S21 to be executed by the microprocessor (also not shown) at every predetermined time interval in the course of the main routine.

In a step S22, the throttle opening degree $\alpha$ is fetched from the output of the throttle position sensor 4.

In a step S23, the output value $\alpha'$ of the throttle position sensor 4 fetched in the proceeding routine S21 is read out from the RAM (not shown).

In a step S24, the throttle opening degree $\alpha$ fetched currently is stored as the updated value $\alpha'$ in the RAM. In a step S25, the magnitude of change $\Delta\alpha$ in the throttle opening degree is determined in accordance with $\Delta\alpha=\alpha-\alpha'$. In this manner, the magnitude of change $\Delta\alpha$ in the throttle opening degree is determined periodically at every predetermined time interval.

In a step S26, decision is made as to whether the magnitude of change $\Delta\alpha$ in the throttle opening degree is of plus or minus sign. When it is decided that the magnitude of change $\Delta\alpha$ is of minus sign, the processing proceeds to a step S27 where the magnitude of the change in the throttle opening degree $\Delta\alpha$ of minus sign is determined (i.e., $\Delta\alpha=\alpha'-\alpha$).

By contrast, when the decision step S26 results in that the magnitude of change $\Delta\alpha$ in the throttle opening degree is of plus sign, the processing proceeds to a step S28 where this magnitude of change $\Delta\alpha$ is compared with the first throttle-acceleration decision reference value $\alpha_{03}$.

When it is decided in the step S28 that $\Delta\alpha \geqq \alpha_{03}$ (i.e., when the magnitude of change $\Delta\alpha$ in the throttle opening degree indicates the acceleration state of the engine), the processing proceeds to a step S29 where a predetermined value $T_{ACC}$ is set at the acceleration end decision timer $TMR_{ACC}$ (refer to FIG. 6 at (E), time point $t_1$), which is then followed by a step S30. On the contrary, when the decision step S28 shows that $\Delta\alpha<\alpha_{03}$, the step S30 is executed immediately in succession to the step S28.

In the step S30,the magnitude of change $\Delta\alpha$ in the throttle opening degree is compared with the second throttle-acceleration decision reference value $\alpha_{02}$ mentioned hereinbefore (refer to FIG. 6, (B)).

When the decision step S30 results in that $\Delta\alpha \geqq \alpha_{02}$ (i.e., when the acceleration state of the engine is detected on the basis of the magnitude of change $\Delta\alpha$ in the throttle opening degree), the processing then proceeds to a step S31 where the deceleration end decision timer $TMR_{DEC}$ is cleared, whereupon a step S36 is executed for the purpose to facilitate the decision of acceleration even when the driver depresses the acceleration pedal during deceleration of the engine. When it is decided in the step S30 that $\Delta\alpha<\alpha_{02}$, a step S36 is executed in succession to the step S30.

When it is decided in the step S26 that the magnitude of change $\Delta\alpha$ in the throttle opening degree is of minus sign, the processing proceeds to the step S27 to determine the magnitude of change $\Delta\alpha$ in accordance with $\Delta\alpha=\alpha'-\alpha$, which is then followed by execution of a step S32 where the magnitude of change $\Delta\alpha$ in the throttle opening degree is compared with the first throttle-deceleration decision reference value $\alpha_{04}$ mentioned hereinbefore (see FIG. 6 at (B)).

When the decision step S32 shows that $\Delta\alpha\geqq\alpha_{04}$ (i.e., when the deceleration state of the engine is detected on the basis of the magnitude of change $\Delta\alpha$ in the throttle opening degree), the processing proceeds to a step S34 where the acceleration end decision timer $TMR_{ACC}$ is cleared, which is then followed by execution of a step S34 for the purpose of facilitating the decision for deceleration even when the driver releases the acceleration pedal in the course of acceleration, as described hereinbefore. On the contrary, when it is decided in the step S32 that $\Delta\alpha<\alpha_{04}$, a step S34 is executed after the step S32.

In the step S32, magnitude of change $\Delta\alpha$ is compared with the second throttle-deceleration decision reference value $\alpha_{01}$ mentioned hereinbefore (see FIG. 6 at (B)).

When it is decided in the step S34 that $\Delta\alpha\geqq\alpha_{01}$ (i.e., when the deceleration state is determined on the basis of the magnitude of change $\Delta\alpha$, the processing proceeds to a step S35 where a predetermined value $T_{DEC}$ is set at the deceleration end decision timer $TMR_{DEC}$ (see FIG. 6 at (E), time point $t_6$), whereon a step S36 is executed. However, when it is decided in the step S34 that $\Delta\alpha<\alpha_{01}$, the step S36 is executed in succession to the step S34.

In the steps S36 to S40, processing for decrementing the acceleration end decision timer $TMR_{ACC}$ and the deceleration end decision timer $TMR_{DEC}$ is executed.

More specifically, in the step S36, a timer decrementing processing is so set as to be executed every time when the interruption routine S21 activated at every predetermined time interval as mentioned hereinbefore has been executed a predetermined number of times. In this case, the processing proceeds to a step S37 and, if otherwise, to the step S41.

Through the processing described above, the values set at the acceleration end decision timer $TMR_{ACC}$ and the deceleration end decision timer $TMR_{DEC}$ are progressively decreased or decremented in such manners as illustrated in FIG. 6 at (E) and (F), respectively. The predetermined number of times mentioned above may be selected heuristically and description thereof will be unnecessary.

In the step S37, decision is made as to whether or not the content of the acceleration end decision timer $TMR_{ACC}$ is "0" (zero). When it is not "0", the processing proceeds to the decrementing step S38, whereupon the step S39 is executed. On the other hand, when the step S37 shows that the content of the acceleration end decision timer $TMR_{ACC}$ is zero, the processing proceeds immediately to the step S39.

In the step S39, it is decided whether the value of the deceleration end decision timer $TMR_{DEC}$ is zero or not. Unless it is zero, the processing proceeds to the decrementing step S40 which is then followed by a step S41. If otherwise, the step S41 is executed immediately after the step S39.

Through the steps S41 to S43, the first acceleration decision reference value $f(Q_{a0})$ is set by referencing the timer $TMR_{DEC}$.

More specifically, when it is decided in the step S41 that the value of the deceleration end decision timer $TMR_{DEC}$ is not zero, i.e., when it is decided that a predetermined time has lapsed from the deceleration based on the magnitude of change $\Delta\alpha$ in the throttle opening degree and that the current time lies within the deceleration end period (i.e., the period extending from the time point $t_6$ to $t_{10}$), the processing proceeds to the step S42 where the first acceleration decision reference value $f(Q_{a0})$ is set to the value $XA_{HI}$, which is then followed by the step S44. In this case, the first acceleration decision reference value $f(Q_{a0})$ is changed over to a large value as shown in FIG. 6 at (D), making the acceleration decision difficult or impossible.

When it is determined in the step S41 that the deceleration end decision timer $TMR_{DEC}$ is zero, decision is made that the deceleration is not brought about by the manipulation of the throttle valve. In this case, the processing proceeds to a step S44 where the first acceleration decision reference value $f(Q_{a0})$is set at a value $XA_{LOW}$ which is smaller than the value $XA_{HI}$ to thereby facilitate the decision for the acceleration state of the engine.

Through the steps S44 to S46, the first deceleration decision reference value $g(Q_{a0})$ is set by making use of the deceleration end decision timer $TMR_{DEC}$.

More specifically, when it is decided in the step S44 that the value of the acceleration end decision timer $TMR_{ACC}$ is not equal to zero, i.e., when it is decided that a predetermined time has lapsed from the acceleration brought about by the magnitude of change $\Delta\alpha$ in the throttle opening degree to the acceleration end period (i.e., the period extending from the time point $t_1$ to $t_5$), the processing proceeds to the step S45 where the first deceleration decision reference value $g(Q_{a0})$ is set at the value $XD_{HI}$, whereupon the processing is terminated in the step S47. At that time, the first deceleration decision reference value $g(Q_{a0})$ is changed over to a large value, as illustrated in FIG. 6 at (D), making it difficult or impossible to validate the decision concerning the deceleration of the engine.

When it is decided in the step S44 that the value of the acceleration end decision timer $TMR_{ACC}$ is zero, it is then determined that the acceleration of the engine is not brought about by actuation of the throttle valve, and in the step S46, the first deceleration decision reference value $g(Q_{a0})$ is set at the value $XDLo_w$ which is smaller than the value $XD_{HI}$ for making difficult or impossible the decision concerning the acceleration of the engine, whereupon the step S47 is executed to terminate the instant processing routine.

As is apparent from the foregoing description, FIG. 6 illustrates graphically operations involved in the acceleration and the deceleration of the engine through the control processing described above with reference to the flow charts of FIGS. 4 and 5.

In more concrete, the throttle opening degree $\alpha$ is shown in FIG. 6 at (A), the magnitude of change $\Delta\alpha$ in the throttle opening degree is shown at (B) of the same figure, the intake air amount $Q_a$ is shown at (C), the magnitude of change $\Delta\alpha_a$ of the intake air amount at every predetermined crank angle is shown at (D), the content of the acceleration end decision timer $TMR_{ACC}$ is shown at (E), the content of the deceleration end decision timer $TMR_{DEC}$ is shown at (F), the acceleration decision flag A is shown at (G) and the deceleration decision flag B at (H), respectively.

When the acceleration pedal (not shown) is depressed to bring about the change in the throttle opening degree $\alpha$ as shown in FIG. 6 at (A), the intake air amount $Q_a$ changes in such a manner as illustrated at (C) in FIG. 6. In this figure, it is assumed that the acceleration pedal is depressed during the period from the time points $t_1$ to $t_3$ and that the acceleration pedal is released during the period from the time points $t_6$ to $t_8$. Accordingly, the magnitude of change $\Delta\alpha$ in the throttle opening degree assumes a value of plus sign during the period from the time point $t_1$ to $t_3$, as shown at (B) in FIG. 6, while the magnitude of change $\Delta\alpha$ in the throttle opening degree assumes a value of minus sign during the period from the time point $t_6$ to $t_8$.

Thus, during the period from the time point $t_1$ to $t_3$, the magnitude of change $\Delta\alpha$ ($=\alpha-\alpha'$) in the throttle opening degree is of plus sign and that $\Delta\alpha \geqq \alpha_{03}$. Namely, the condition for setting the acceleration end decision timer $TMR_{ACC}$ is satisfied, and the condition for clearing the same is not satisfied (see FIG. 4, steps S26 to S31, S32 and S33). Accordingly, the acceleration end decision timer $TMR_{ACC}$ is set to the value $T_{ACC}$ during a period from $t_1$ to $t_3$, wherein the content of the acceleration end decision timer $TMR_{ACC}$ is progressively decremented toward the value of "0". Accordingly, the value of the acceleration end decision timer $TMR_{ACC}$ is not zero during the period from the time point $t_1$ to $t_5$, while the first deceleration decision reference value $g(Q_{a0})$ assumes the value $XD_{HI}$ during this period.

Consequently, the first deceleration decision reference value $g(Q_{a0})$ assumes a value increasing in the minus direction beyond zero as indicated by a broken line in FIG. 6 at (D). As a result, upon occurrence of undershoot (see FIG. 6, (D)) in the magnitude of change $\Delta Q_a$ of the intake air amount due to the overshoot immediately following the acceleration (see FIG. 6 at (C)), the first deceleration decision reference value $g(Q_{a0})$ assumes a large value. Thus, the decision of deceleration is precluded. Consequently, during only a sub-period of $t_2$ to $t_4$ for which the magnitude of change $\Delta Q_a$ of the intake air amount is not smaller than the first acceleration decision reference value $f(Q_{a0})$, the acceleration state is determined, whereby the flag A is set to logic "1".

Similarly, during the period of $t_6$ to $t_8$, the magnitude of change $\Delta\alpha$ ($=\alpha-\alpha'$) in the throttle opening degree assumes a value of minus sign and the absolute value of $\Delta\alpha$ (i.e., $|\Delta\alpha|$) is not smaller than the second throttle-deceleration decision reference value $\alpha_{01}$. Thus, the conditions for setting the deceleration end decision timer $TMR_{DEC}$ are satisfied with the clearing conditions being not satisfied (refer to the steps S26, S27, S30, S31, S34 and S35 shown in FIG. 3). Thus, the value of the deceleration end decision timer $TMR_{DEC}$ is set to the value $T_{DEC}$ during the period from $t_6$ to $t_8$ and gradually decremented to "0" (zero). During this period, the first acceleration decision reference value $f(Q_{a0})$ assumes the value of $XA_{HI}$.

For the reasons described above, the first acceleration decision reference value $f(Q_{a0})$ assumes a value increasing in the plus direction beyond zero, as indicated by a broken line in FIG. 6 at (D). In this way, when the value of the first acceleration decision reference value $f(Q_{a0})$ becomes large upon occurrence of overshoot in the magnitude of change $\Delta Q_a$ of the intake air amount due to the undershoot taking place immediately after the acceleration (see FIG. 6 at (D)), the acceleration decision is precluded, while it is allowed during a sub-period from $t_7$ to $t_9$ where $|\Delta Q_a| \geqq g(Q_{a0})$ within the period from $t_6$ to $t_{10}$, whereby the flag B is set to logic "1" as illustrated in FIG. 6 at (H).

Embodiment 2

In the case of the embodiment of the fuel injection control apparatus described above, the change-over or switching of the first acceleration decision reference value (or the first deceleration decision reference value) is effectuated by utilizing the throttle opening degree detecting module. However, the invention is never restricted to the arrangement described above. By way of example, instead of changing over the acceleration decision reference value and the deceleration decision reference value, such arrangement can equally be adopted that when the deceleration state of the engine is decided with the acceleration end decision timer $TMR_{ACC}$ having a value other than zero, the deceleration state of the engine is determined, whereby the fuel is decreased only a little as compared with case where the content of the acceleration end decision timer $TMR_{ACC}$ is zero. Similarly, if the acceleration state is determined when the deceleration end decision timer $TMR_{DEC}$ is not zero, the fuel is increased only a little or not increased when compared with the case where the timer $TMR_{DEC}$ is zero, substantially to he same effects.

Furthermore, although it has been assumed that the intake air amount $Q_a$ of the air flow sensor is utilized as the parameter indicating the intake air amount of the engine, it should be appreciated that the output value of the pressure sensor designed to detect the pressure within the intake pipe can equally be employed substantially to the same effects.

While the invention has been described in terms of its preferred embodiments, it should be understood that numerous modifications may be made thereto without departing from the spirit and scope of the invention as defined in the appended claims, it is intended that all such modifications fall within the scope of the claims.

What is claimed is:

1. A fuel injection control apparatus for an internal combustion engine, comprising:

at least one fuel injector;

load detecting means for detecting a load of said engine;

throttle position detecting means for detecting an opening degree of a throttle valve of said engine; and a controller comprising a microprocessor programmed to perform the functions and operations comprising:

fuel increasing means for increasing an amount of fuel injected into said engine by deciding acceleration of said engine when an increase in the engine load detected by said load detecting means during a predetermined period exceeds a first preset acceleration decision reference value;

fuel decreasing means decreasing the amount of fuel injected into said engine by deciding deceleration of said engine when a decrease in the load detected by said load detecting means during a predetermined period exceeds a first preset deceleration decision reference value;

throttle acceleration decision means for deciding acceleration of said engine when a magnitude of change of said throttle opening occurring in a positive direction during a predetermined period as detected by said throttle position detecting means exceeds a preset decision reference value; and change-over means for changing over said first deceleration decision reference value for said fuel decreasing means to a value greater than a normal value for a predetermined period starting from a time point when a decision of acceleration is made by said throttle acceleration decision means to thereby control said fuel injector according to said acceleration decision and said throttle acceleration decision.

2. A fuel injection control apparatus for an internal combustion engine according to claim 1, wherein said fuel increasing means includes:

an acceleration decision module for comparing the output of said load detecting means with a first acceleration decision reference value for deciding the acceleration of said engine; and a fuel increasing module for increasing the amount of fuel injected into said engine in dependence on the output of said acceleration decision module.

3. A fuel injection control apparatus for an internal combustion engine according to claim 1, wherein said fuel decreasing means includes:

a deceleration decision module for comparing the output of said load detecting means with a first deceleration decision reference value for deciding the deceleration of said engine; and a fuel decreasing module for decreasing the amount of fuel injected into said engine in dependence on the output of said deceleration decision module.

4. A fuel injection control apparatus for an internal combustion engine, comprising:

at least one fuel injector;

load detecting means for detecting a load of said engine;

throttle position detecting means for detecting an opening degree of a throttle valve of said engine; and a controller comprising a microprocessor programmed to perform the functions and operations comprising:

fuel increasing means for increasing an amount of fuel injected into said engine by deciding acceleration of said engine when an increase in the engine load detected by said load detecting means during a predetermined period exceeds a first preset acceleration decision reference value;

fuel decreasing means decreasing the amount of fuel injected into said engine by deciding deceleration of said engine when a decrease in the load detected by said load detecting means during a predetermined period exceeds a first preset deceleration decision reference value;

throttle deceleration decision means for deciding deceleration of said engine when a magnitude of change of said throttle opening occurring in a negative direction during a predetermined period as detected by said throttle position detecting means exceeds a preset decision reference value; and change-over means for changing over said first deceleration decision reference value for said fuel decreasing means to a value greater than a normal value for a predetermined period starting from a time point when a decision of deceleration is made by said throttle acceleration decision means to thereby control said fuel injector according to said acceleration decision and said throttle deceleration decision.

5. A fuel injection control apparatus for an internal combustion engine according to claim 4, wherein said fuel increasing means includes:

an acceleration decision module for comparing the output of said load detecting means with a first acceleration decision reference value for deciding the acceleration of said engine; and a fuel increasing module for increasing the amount of fuel injected into said engine in dependence on the output of said acceleration decision module.

6. A fuel injection control apparatus for an internal combustion engine according to claim 4, wherein said fuel decreasing means includes:

a deceleration decision module for comparing the output of said load detecting means with a first deceleration decision reference value for deciding the deceleration of said engine; and a fuel decreasing module for decreasing the amount of fuel injected into said engine in dependence on the output of said deceleration decision module.

7. A fuel injection control apparatus for an internal combustion engine comprising:

at least one fuel injector;

load detecting means for detecting a load of said engine;

a controller comprising a microprocessor programmed to perform the functions and operations comprising:

fuel increasing means for increasing an amount of fuel injected into said engine by deciding acceleration of said engine when an increase in the engine load detected by said load detecting means during a predetermined period exceeds a first preset acceleration decision reference value;

fuel decreasing means decreasing the amount of fuel injected into said engine by deciding deceleration of said engine when a decrease in the load detected by said load detecting means during a predetermined period exceeds a first preset deceleration decision reference value;

change-over means for changing over said first deceleration decision reference value for said fuel decreasing means to a value greater than a normal value for a predetermined period starting from a time point when said increase of the engine load detected by said load detecting means during said predetermined period exceeds said first acceleration decision reference value or alternatively a second acceleration decision reference value which is greater than said first acceleration decision reference value.

8. A fuel injection control apparatus for an internal combustion engine according to claim 7, wherein said fuel increasing means includes:

an acceleration decision module for comparing the output of said load detecting means with a first acceleration decision reference value for deciding the acceleration of said engine; and a fuel increasing module for increasing the amount of fuel injected into said engine in dependence on the output of said acceleration decision module.

9. A fuel injection control apparatus for an internal combustion engine according to claim 7, wherein said fuel decreasing means includes:

a deceleration decision module for comparing the output of said load detecting means with a first deceleration decision reference value for deciding the deceleration of said engine; and a fuel decreasing module for decreasing the amount of fuel injected into said engine in dependence on the output of said deceleration decision module.

10. A fuel injection control apparatus for an internal combustion engine comprising:

at least one fuel injector;

load detecting means for detecting a load of said engine;

a controller comprising a microprocessor programmed to perform the functions and operations comprising:

fuel increasing means for increasing an amount of fuel injected into said engine by deciding acceleration of said engine when an increase in the engine load detected by said load detecting means during a predetermined period exceeds a first preset acceleration decision reference value;

fuel decreasing means decreasing the amount of fuel injected into said engine by deciding deceleration of said engine when a decrease in the load detected by said load detecting means during a predetermined period exceeds a first preset deceleration decision reference value;

change-over means for changing over said first deceleration decision reference value for said fuel increasing means to a value greater than a normal value for a predetermined period starting from a time point when said decrease of the engine load detected by said load detecting means during said predetermined period exceeds said first deceleration decision reference value or alternatively a second deceleration decision reference value which is greater than said first deceleration decision reference value.

11. A fuel injection control apparatus for an internal combustion engine according to claim 10, wherein said fuel increasing means includes:

an acceleration decision module for comparing the output of said load detecting means with a first acceleration decision reference value for deciding the acceleration of said engine; and a fuel increasing module for increasing the amount of fuel injected into said engine in dependence on the output of said acceleration decision module.

12. A fuel injection control apparatus for an internal combustion engine according to claim 10, wherein said fuel decreasing means includes:

a deceleration decision module for comparing the output of said load detecting means with a first deceleration decision reference value for deciding the deceleration of said engine; and a fuel decreasing module for decreasing the amount of fuel injected into said engine in dependence on the output of said deceleration decision module.

* * * * *